US005228874A

United States Patent [19]

Lin

[11] Patent Number: 5,228,874

[45] Date of Patent: Jul. 20, 1993

[54] FEMALE COMPUTER CONNECTOR

[75] Inventor: James Lin, Taipei, Taiwan

[73] Assignee: Taiwan Line Tek Electronic Co., Ltd., Hsien, Taiwan

[21] Appl. No.: 944,956

[22] Filed: Sep. 15, 1992

[51] Int. Cl.[5] ..... H01R 13/502

[52] U.S. Cl. ..... 439/687; 439/604

[58] Field of Search ..... 439/604, 686, 687, 690, 439/695, 696, 701, 578, 731, 752

[56] References Cited

U.S. PATENT DOCUMENTS

| | | | |
|---|---|---|---|
| 3,525,972 | 8/1970 | Asick et al. | 439/687 X |
| 4,671,601 | 6/1987 | Lomecka | 493/687 X |
| 4,693,539 | 9/1987 | Tighe, Jr. | 439/752 X |
| 5,078,620 | 1/1992 | Verhoeven | 439/548 |

*Primary Examiner*—Daniel W. Howell
*Assistant Examiner*—Kheim Nguyen
*Attorney, Agent, or Firm*—Bucknam and Archer

[57] ABSTRACT

A female computer connector includes a flat insert connected to a housing to hold a set of receptacles therein and molded with an outer shell through the process of injection molding, wherein the housing has elongated ribs inserted into gaps on a front edge of the flat insert to separate the receptacles; the receptacles each has two projections respectively hooked in two spaced recessed retaining surface portions on a respective channel on the flat insert for positioning, and a rear end formed into two side wings pinched to bind up a respective conductor.

3 Claims, 4 Drawing Sheets

FEMALE COMPUTER CONNECTOR

BACKGROUND OF THE INVENTION

The present invention relates to computer connectors and relates more particularly to a female computer connector fastened to a computer mainframe for connecting a male computer connector on a cable from a computer peripheral equipment.

The requirement on the quality of a computer connector is very critical because any tiny structural defects may cause a transmission error. According to conventional methods, a computer connector is generally made through the process of injection molding. In order to prevent the pin holes from being blocked during the process of injection molding, each receptacle shall be sleeved with a bush made of a high molecular compound. This arrangement complicates the manufacturing process of a computer connector. Furthermore, the receptacles may be moved out of position or become tangled during the process of injection molding. If any receptacle tilted on one side, a higher impedance will be produced in interfering the quality of transmission.

SUMMARY OF THE INVENTION

The present invention eliminates the aforesaid problems. According to one aspect of the present invention, the female computer connector is generally comprised of a flat insert connected to a housing to hold a set of receptacles therein and molded with an outer shell through the process of injection molding, wherein the housing has elongated ribs inserted into gaps on a front edge of the flat insert to separate the receptacles from one another. According to another aspect of the present invention each receptacle has two projections respectively hooked in two spaced recessed retaining surface portions on a respective channel on the flat insert for positioning, and a rear end formed into two side wings pinched to bind up a respective conductor. Therefore, the receptacles are firmly retained in place and will not be moved out of position during the process of injection molding in molding the outer shell on the flat insert and the housing.

DETAILED DESCRIPTION OF THE PREFERRED EMBODIMENT

Referring to the annexed drawings in detail, a computer connector as constructed in accordance with the present invention is generally comprised of a housing 1, an insert 2, and receptacles 3.

Figure 1A:
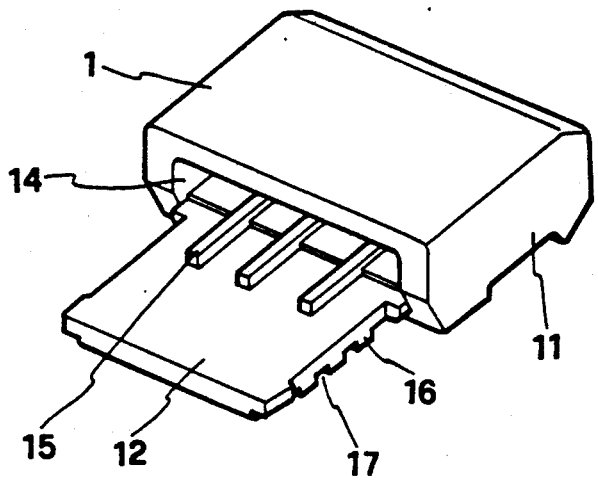
FIGS. 1A, 1B, 1C are elevational views taken in different directions of a housing for a female computer connector according to the present invention.
Figure 1B:
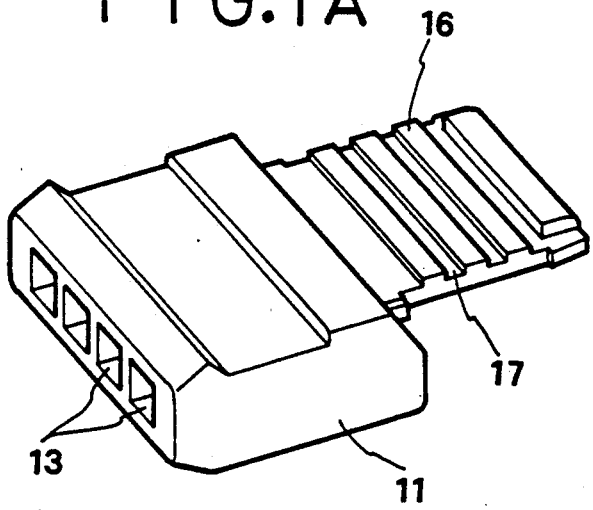
Figure 1C:
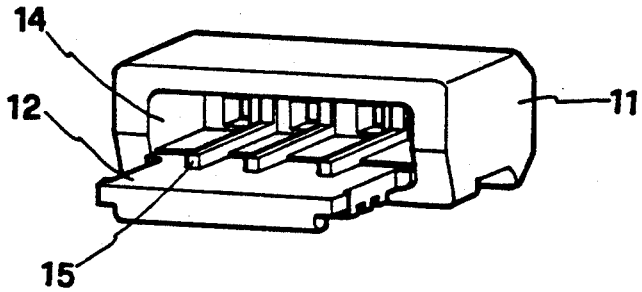

Referring to FIGS. 1A, 1B and 1C, the housing 1 is integrally made from a high molecular compound and comprised of a base 11 and an extension board 12. The base 11 has a set of taper slots 13 on one side wall thereof in number according to the quantity of the receptacles 3 to be fastened, a back chamber 14 in communication with the set of taper slots 13, and a plurality of elongated ribs 15 in separating the taper slots 13 from one another. The extension board 12 has a set of parallel ribs 16 on a back side thereof defining a plurality of parallel grooves 17 therein.

Figure 2A:
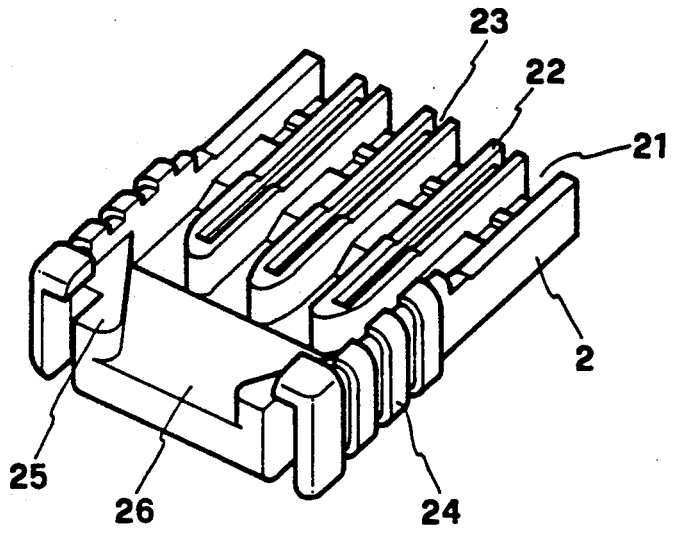
FIGS. 2A and 2B are elevational views taken in different directions of an insert for a female computer connector according to the present invention.
Figure 2B:
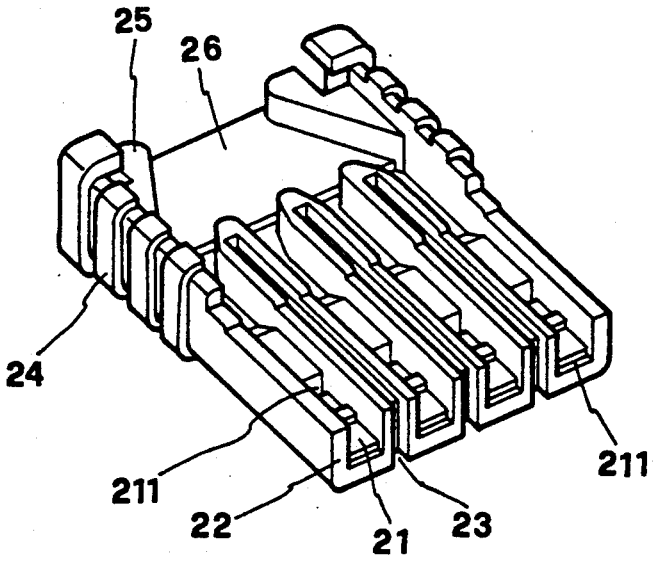

Referring to FIGS. 2A and 2B, the insert 2 is integrally made of a high molecular compound in a flat structure, having a set of parallel channels 21 of which each receives a respective receptacle 3, a plurality of gaps 23 on a front edge 22 thereof respectively separated by the parallel channels 21 of which each receives either elongated rib 15 of the housing 1, pairs of side ribs 24 on two opposite upright side walls thereof, and a passage way 26 defined between two opposed bevel flanges 25 on the inside adjacent to a rear end thereof through which cables are inserted, wherein each parallel channel 21 has two recessed retaining surface portions 211 spaced adjacent to the respective front end.

Figure 3A:
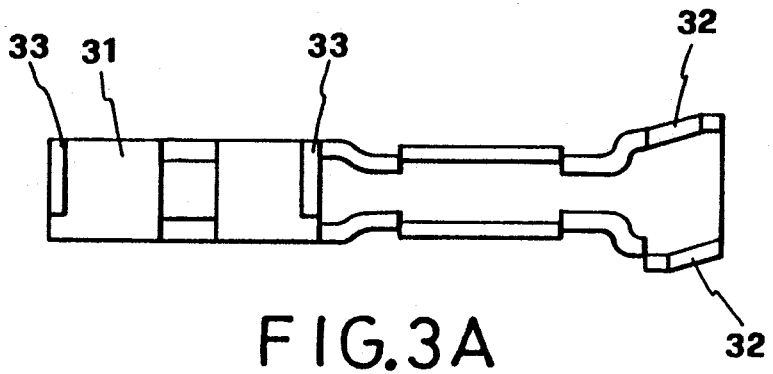
FIGS. 3A and 3B are sectional views taken in different directions of a receptacle for a female computer connector according to the present invention.
Figure 3B:
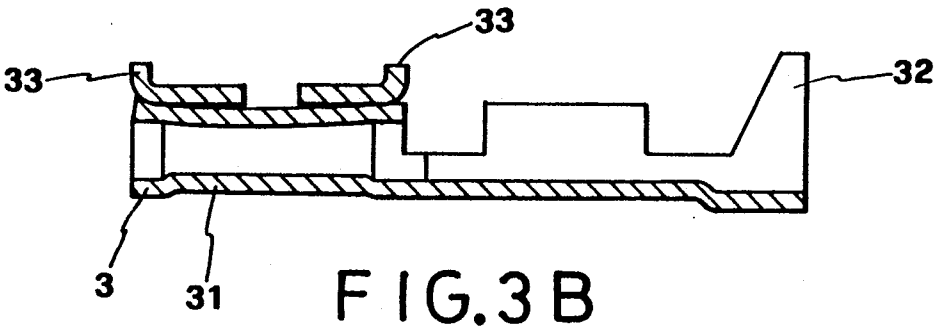

Referring to FIGS. 3A and 3B, each respective 3 fits into either channel on the insert 2, having two spaced projections 33 on a front collar 31 thereof respectively hooked in the two spaced retaining surface portions 211 on either channel 21 of the insert 2 and a rear end terminated into two side wings 32 for binding up a respective conductor.

Figures 4A, 4B:
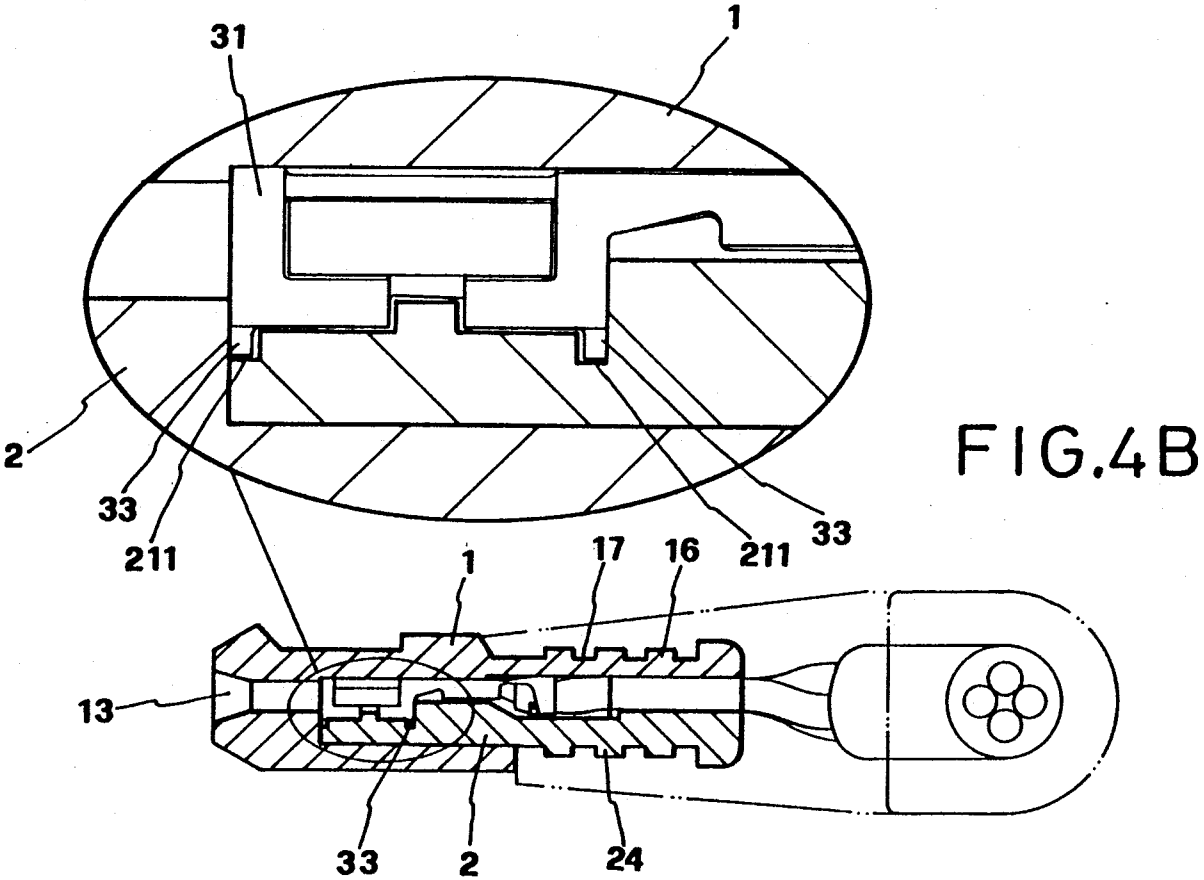
FIGS. 4A and 4B are cross sections showing the receptacles fastened in the insert coupled to the housing and molded with an outer shell and formed into a female computer connector.

Referring to FIG. 4, as the receptacles 3 have been coupled with a respective conductor and respectively fitted into either channel 21 on the insert 2, the insert 2 is fastened to the housing 1 with the elongated ribs 15 on the housing 1 inserted into the gaps 23 on the insert 2 respectively. When connected, the assembly is put into a molding die and molded with a plastic outer shell (see the dotted lines) through the process of injection molding. After the process of injection molding, the plastic outer shell fills in the gaps in the side ribs 24 on the insert 2 and the parallel grooves 17 on the extension board 12 of the housing 1, and therefore the housing 1, the insert 2 and the outer shell are tightly bound together.

It is to be understood that the drawings are designed for purposes of illustration only, and are not intended as a definition of the limits and scope of the invention disclosed.

What is claimed is:

1. A female computer connector comprising:

a housing having a horizontal extension board extended from a base, said base having a set of taper slots on a vertical front wall thereof which receive the pins of a matched male computer connector, a back chamber in communication with the taper slots, and a plurality of elongated ribs in separating the taper slots from one another, said extension board having a set of parallel ribs on a back side thereof defining a plurality of parallel grooves therein;

a flat insert having a set of parallel channels, a set of gaps on a front edge thereof respectively separated by the parallel channels of which each receives either elongated rib of said housing, pairs of side ribs on two opposite upright side walls thereof, and a passage way defined between two opposed bevel flanges on the inside adjacent to a rear end thereof through which conductors are inserted into the parallel channels, each parallel channel having two recessed retaining surface portions spaced adjacent to a respective front end; and a plurality of receptacles respectively fitted into either parallel channel on said insert and coupled to the conductors, each receptacle having two spaced projections on a front collar thereof respectively hooked in the two spaced retaining surface portions on either channel on said insert and a rear end terminated into two side wings pinched to bind up a respective conductor, the front collar of each receptacle being disposed in line with either taper slot on said housing to receive either pin of a matched male computer connector.

2. The female computer connector of claim 1 wherein each channel has an inside surface curved inwards and outwards for retaining the respectively receptacle in place and keeping it springy.

3. The female computer connector of claim 1 wherein the elongated ribs on said housing insert in the gaps on the front edge of said flat insert to isolate said receptacles from one another in preventing from short circuit and high voltage test failure.

* * * * *